US009194022B2

(12) United States Patent
Roy et al.

(10) Patent No.: US 9,194,022 B2
(45) Date of Patent: Nov. 24, 2015

(54) UPGRADING OF PRECIOUS METALS CONCENTRATES AND RESIDUES

(75) Inventors: Alain Roy, Kingston (CA); Boyd R. Davis, Kingston (CA); Leslie James Bryson, Benoni (ZA); Lloyd Robert Nelson, Johannesburg (ZA); Stephen Farring Woollam, Johannesburg (ZA); Victor Loyiso Vusumzi Mtotywa, Midrand (ZA)

(73) Assignee: Rustenburg Platinum Mines Limited, Johannesburg (ZA)

( * ) Notice: Subject to any disclaimer, the term of this patent is extended or adjusted under 35 U.S.C. 154(b) by 16 days.

(21) Appl. No.: 13/806,106

(22) PCT Filed: Jun. 17, 2011

(86) PCT No.: PCT/IB2011/052644

§ 371 (c)(1),
(2), (4) Date: Mar. 1, 2013

(87) PCT Pub. No.: WO2011/161597

PCT Pub. Date: Dec. 29, 2011

(65) Prior Publication Data

US 2013/0177487 A1 Jul. 11, 2013

(30) Foreign Application Priority Data

Jun. 22, 2010 (ZA) ..... 2010/04397

(51) Int. Cl.

| | |
|---|---|
| ***C22B 1/00*** | (2006.01) |
| ***C22B 7/00*** | (2006.01) |
| ***C22B 3/00*** | (2006.01) |
| ***C22B 1/04*** | (2006.01) |
| ***C22B 1/08*** | (2006.01) |
| ***C22B 11/06*** | (2006.01) |

(52) U.S. Cl.

CPC . *C22B 7/002* (2013.01); *C22B 1/00* (2013.01); *C22B 1/04* (2013.01); *C22B 1/08* (2013.01); *C22B 11/04* (2013.01); *C22B 11/06* (2013.01)

(58) Field of Classification Search

None

See application file for complete search history.

(56) References Cited

U.S. PATENT DOCUMENTS

| | | | | | |
|---|---|---|---|---|---|
| 413,686 | A | * | 10/1889 | Simmonet | 423/46 |
| 1,937,661 | A | * | 12/1933 | Meyer | 423/46 |
| 1,943,331 | A | * | 1/1934 | Mitchell | 423/109 |
| 3,432,255 | A | | 3/1969 | Long Ray | 23/16 |
| 4,086,084 | A | * | 4/1978 | Oliver et al. | 423/44 |
| 4,092,152 | A | | 5/1978 | Borbely | 75/7 |
| 4,259,107 | A | | 3/1981 | Guay | 75/105 |
| 4,578,163 | A | | 3/1986 | Kunter | 204/110 |
| 6,626,978 | B1 | | 9/2003 | Prior | 75/631 |

FOREIGN PATENT DOCUMENTS

| | | | |
|---|---|---|---|
| CA | 2 181 369 A1 | | 6/1996 |
| CA | 2303046 | * | 3/1999 |
| CA | 2 314 581 A1 | | 1/2001 |
| GB | 1 502 765 A | | 3/1978 |
| WO | 99/22036 A1 | | 5/1999 |
| WO | 99/60178 | * | 11/1999 |
| ZA | 98-09682 | * | 10/1998 |

OTHER PUBLICATIONS

ISR for related PCT/IB2011/052644 mailed on Oct. 27, 2011.

PCT International Preliminary Report on Patentability Chapter I (with Written Opinion) from PCT/IB2011/052644 dated Dec. 28, 2012.

* cited by examiner

*Primary Examiner* — Steven Bos

(74) *Attorney, Agent, or Firm* — Ladas & Parry, LLP

(57) ABSTRACT

A process for upgrading a precious metals-containing concentrate or residue results in near-quantitave removal of base metals and several impurity elements at elevated temperatures. The precious metals-containing concentrate or residue is exposed to oxygen or an oxygen-containing environment in an oxidative pre-treatment step followed by treatment with a hydrochlorinating agent in a hydrochlorination step to form an upgraded concentrate or residue.

20 Claims, 3 Drawing Sheets

UPGRADING OF PRECIOUS METALS CONCENTRATES AND RESIDUES

CROSS-REFERENCE TO RELATED APPLICATIONS

This application is the U.S. national stage of international patent application no. PCT/IB2011/052644 filed on Jun. 17, 2011, which claims priority to South African patent application no. 2010/04397 filed on Jun. 22, 2010, the disclosures of which are hereby incorporated by reference in their entireties.

BACKGROUND TO THE INVENTION

This invention relates to a process to effect impurity removal and upgrading of precious metals concentrates and residues so rendering them more amenable to downstream refining.

As is known in the art, subsequent to mining of precious metal ores and before final separation and purification of the precious metals in the refining process, precious metal residues and concentrates are produced and used as feedstock in the refining process. However, in addition to the precious metals, the residues and concentrates also include base metals (such as cobalt, copper, iron and nickel, for example), amphoterics (such as sulfur, selenium and tellurium, for example), and other impurities (including, but not limited to lead, zinc, tin, silver, arsenic, antimony and bismuth). The presence of these species significantly complicates the refining process.

A number of processes involving chlorination of precious metals feedstocks (concentrates produced by ore dressing, precious metals-bearing residues, precious metals-bearing matte and metal concentrates produced post leaching of base metals) have previously been disclosed in an attempt to effect upfront removal of base metals, amphoterics and other impurities.

CA 2,314,581 discloses a process comprising three (or four) steps of:

(i) subjecting the feedstock to a high temperature treatment with hydrogen chloride gas (HCl (g));
(ii) optional chlorination (under a chlorine atmosphere);
(iii) oxidation with oxygen; and
(iv) reduction (under a hydrogen atmosphere).

Thermodynamic calculations have indicated that a disadvantage of this process is that the reaction of base metals, amphoterics and other impurities directly with hydrogen chloride gas requires a significant stoichiometric excess of hydrogen chloride. The reason for this is that for base metals the concentration of hydrogen chloride must be much higher than that of the hydrogen that is generated by the hydrochlorination reaction to permit the hydrochlorination reaction to proceed. Moreover, it has been observed that direct reaction of certain feedstocks with hydrogen chloride at elevated temperatures has the potential to result in the formation of an intermediate molten phase, which further complicates processing, in particular by limiting effective gas-solid contact. A further disadvantage to this process is that the secondary direct chlorination is prone to the formation of volatile precious metals chlorides, resulting in increased loss of precious metals.

CA 2,181,369 discloses a process including the steps of:

(i) exposing the feedstock to an oxidising environment (preferably oxygen or an oxygen containing gas mixture);
(ii) reduction (under hydrogen); and
(iii) chlorination using chlorine.

The disclosed three step process requires a hydrogen reduction step. The act of reduction following oxidation not only adds an extra processing step, but further reduces metal oxide species back to metal prior to chlorination. In addition, the proposed step of final chlorination with chlorine or chlorine-containing gas results in a partial loss of precious metals.

U.S. Pat. No. 3,432,255 discloses a process for the recovery of molybdenum, tin, antimony, bismuth and like metal values from their ores and minerals. The source material is contacted with hydrogen chloride and an oxidizing gas at a temperature sufficiently high that the metal values are converted to volatile chloride compounds and removed from the reaction zone. The impurity metal values are said to remain as a residue of oxides which are substantially non-volatile under the process temperatures.

GB 1 502 765 and related applications U.S. Pat. No. 4,086,084 and U.S. Pat. No. 4,260,139 disclose a process for refining a metal concentrate comprising at least one precious metal, silver and a base metal, which base metal and silver form volatile halides so as to separate them from the precious metal(s). The process comprises contacting the metal concentrate in the form of a solid mixture with a halogen-containing gas at a temperature which is sufficiently high for the base metal and silver to form their halides and for said halides to volatilize from the solid mixture. The volatilized halides are removed from the solid precious metal-containing residue.

U.S. Pat. No. 4,092,152 discloses a method of reducing the presence of impurities from a sulphur-containing feed material such as dust and hydrometallurgical wastes that result from smelting and refining operations. Pelletized feed materials are heated to 800° C. to 1150° C. and reacted with a gas stream containing chlorine and oxygen. A limitation of the proposed treatment process is that it effects removal only of certain impurity species from precious metals, while failing to remove base metals and promoting precious metal losses.

Upfront removal of amphoterics, base metals and other impurities is expected to give rise to improved separation efficiencies, allowing for changes in and optimization of downstream refining processes and creation of additional refining capacity. It is accordingly an object of the present invention to provide a simple, effective and robust process of upgrading precious metal concentrates that will at least partially alleviate the disadvantages associated with existing technologies.

SUMMARY OF THE INVENTION

According to the present invention, there is provided a process for upgrading a precious metals-containing concentrate or residue, the process including the steps of:

(i) oxidative pre-treatment of the precious metals-containing concentrate or residue by exposing it to oxygen or an oxygen-containing environment; and
(ii) hydrochlorination of the pre-treated concentrate or residue by exposing it to a hydrochlorinating agent to form an upgraded concentrate or residue.

In some embodiments of the invention, the oxidative pre-treatment step comprises pyrometallurgical oxidation of the precious metals-containing concentrate or residue. In some embodiments, the pyrometallurgical oxidation is carried out under an oxygen or oxygen-containing atmosphere, at a temperature of between 200° C. and 1400° C., or between 400° C. and 900° C. The upper limit of the temperature range is controlled to limit the potential for volatile precious metals losses.

In some embodiments of the invention, the oxidative pre-treatment step comprises hydrometallurgical oxidation of the precious metals-containing concentrate or residue. In some embodiments, the hydrometallurgical process is carried out at a temperature of between 50° C. and 300° C., or between 100° C. and 200° C.

In some embodiments of the invention, the process includes thermal decomposition of sulfur present as sulfates in the concentrate or residue, by processing the feed concentrate or residue at temperatures up to 1300° C. substantially in the absence of oxygen, either prior to or post the oxidative pre-treatment step.

In some embodiments of the invention, the pre-treated concentrate or residue is pre-heated to decompose precious metal oxides and reduce available oxygen prior to hydrochlorination (with, or without, the aid of an environment substantially free of gaseous oxygen), either as an entirely separate process step, or directly en-route, but prior to, hydrochlorination.

In some embodiments of the invention, the hydrochlorination step is conducted substantially in the absence of free oxygen in the gas phase, to limit loss of precious metals.

In some embodiments of the invention, the hydrochlorination step is carried out at a temperature of between 650° C. and 1300° C., or between 800° C. and 1100° C.

In some embodiments of the invention, the pyrometallurgical oxidative pre-treatment step effects prior removal of some volatile amphoteric and impurity species.

In some embodiments of the invention, the concentrate or residue comprises a precious metals content ranging from 0.5% to 60% by weight. In some embodiments, the concentrate or residue contains in excess of 20% by weight precious metals.

In some embodiments of the invention, during the hydrochlorination step, the ratio of hydrogen chloride (HCl) to water ($H_2O$) is controlled so as to minimise precious metals chloride formation and resultant losses, in particular to limit the loss of ruthenium. In some embodiments, water is added in a controlled manner into the reactive gas feed to fix the inlet $HCl/H_2O$ ratio.

In some embodiments of the invention, during the hydrochlorination step, hydrogen gas is added in a controlled manner to scavenge any trace amounts of deleterious chlorine and/or oxygen present.

BRIEF DESCRIPTION OF THE FIGURES

The invention will now be described in more detail, by way of example only, with reference to the accompanying figures.

DETAILED DESCRIPTION OF THE INVENTION

Figure 1:
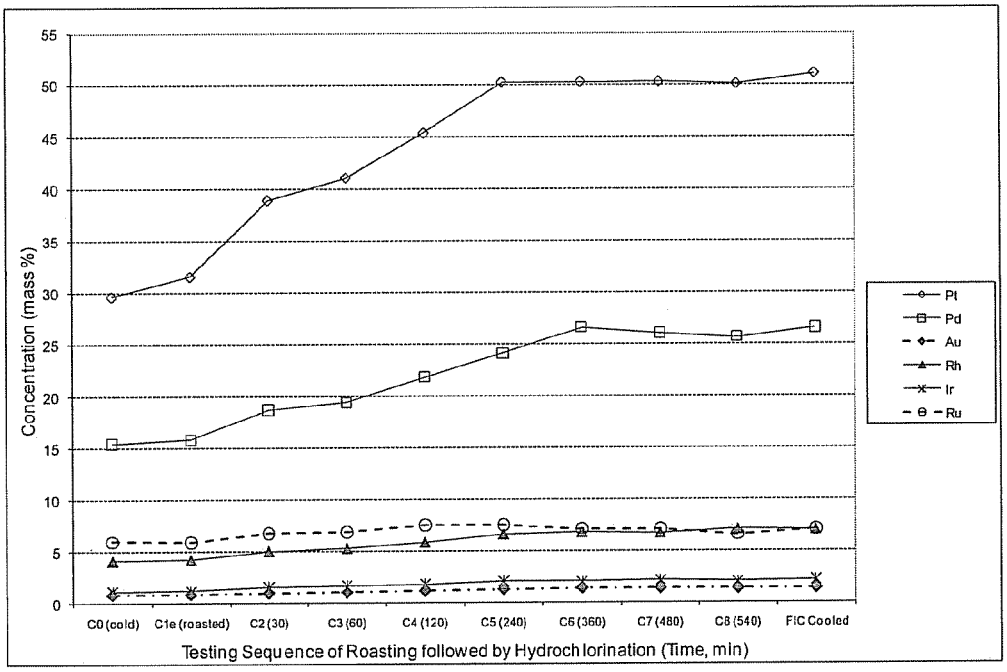
FIG. 1 is a graph indicating the progressive refining of base metals based on the actual concentration of elements in accordance with the process of an embodiment of the invention.

As used herein, "precious metals" includes one or more of gold and the platinum group metals platinum, palladium, rhodium, ruthenium and iridium.

As used herein, "oxidative pre-treatment" is understood to be a process step in which a precious metals-containing concentrate or residue is exposed to oxygen or an oxygen containing environment, typically a pyrometallurgical oxidation process, although a hydrometallurgical process is also envisaged, in order to oxidise, amongst other purposes, base metal contaminants present in the concentrate or residue in order to render them suitable for refining from the concentrate or residue by hydrochlorination.

As used herein, the "hydrochlorinating agent" includes hydrogen chloride gas and can include anhydrous hydrogen chloride gas (as most typically used in the examples cited), but for industrial application, recovery and recycle of hydrogen chloride from the product gases of the hydrochlorination step is anticipated, in which event the hydrochlorinating agent would more typically be recycled hydrogen chloride gas, potentially containing traces of impurity moisture and hydrogen.

The method of upgrading precious metals-containing concentrates results in near-quantitative removal of base metals and several impurity elements at elevated temperatures by treatment under oxygen (or an oxygen-containing environment) in the oxidative pre-treatment step, followed by treatment with a hydrochlorinating agent in the hydrochlorination step. Concentrates and residues including precious metals, base metals, amphoterics and other impurity metals can be used as the feedstock in the proposed process, to yield precious metals-containing residues amenable to further refining to saleable precious metals in existing downstream precious metals refineries.

It has been found that reactions of base metals and base metal oxides with hydrogen chloride at elevated temperatures produces base metal chlorides that possess elevated vapour pressures (at the temperatures adopted for hydrochlorination), and as such can be removed selectively from the precious metals by volatilization. Reaction of hydrogen chloride with precious metals is simultaneously suppressed by the small ratios of hydrogen ($H_2$) and water ($H_2O$) produced (in hydrochlorination of base metals and base metal oxides, respectively) relative to excess HCl, in combination with a suitably low temperature, and this can help to secure that the precious metals remain virtually unreacted.

It has also been found that this role can deliberately be enhanced through controlled addition of some water to the hydrochlorinator, to secure thermodynamic conditions of a sufficiently low $HCl/H_2O$ ratio so that the hydrochlorination of any residual PGM oxides is substantially supressed, yet the $HCl/H_2O$ ratio remains adequate to continue support of hydrochlorination and removal of volatile base metal and impurity chlorides. The precious metals remain virtually unreacted. Any precious metal chlorides inadvertently produced possess extremely low vapour pressures at the temperatures adopted for hydrochlorination and so remain in the upgraded solid residue.

As indicated by the reaction sequences below, the invention relies on the improved high temperature hydrochlorination of base metal oxides over base metals, and the fact that precious metals can be rendered relatively inert to a sequence of oxidation followed by hydrochlorination, especially if suitable environmental controls are exercised prior to onset of hydrochlorination (i.e., potentially fix temperature and/or apply an inert atmosphere). Following oxidation, the hydrochlorination of a metal oxide (hereinafter referred to as MO) proceeds better than hydrochlorination of the corresponding metal (M), since the reaction to produce water vapour:

$$MO+2HCl=MCl_2+H_2O$$

is thermodynamically preferred for most metal oxides over the reaction of their corresponding metals to produce hydrogen:

$$M+2HCl=MCl_2+H_2$$

This results in hydrochlorination of base metal oxides requiring a lower stoichiometric excess of hydrogen chloride gas than the corresponding direct hydrochlorination of base metals (i.e., gaseous molar $HCl/H_2O$ ratio for hydrochlorination of base metals oxides is at least an order of magnitude lower relative to the corresponding gaseous molar $HCl/H_2$ ratio for hydrochlorination of most base metals).

This has decided processing and economic benefits; specifically less gaseous "hydrochlorinating agent" is required to effect refining of the volatile base metal chlorides from the precious metals, with associated smaller gas feeding and product gas handling and hydrogen chloride recovery systems being required. Significantly, this prompts switching the reaction sequence from the prior art of three (or four) stage hydrochlorination followed by oxidation and reduction with hydrogen gas (CA 2,314,581) or pre-oxidation followed by reduction and chlorination (CA 2,181,369), to a simpler two-stage process involving an oxidative pre-treatment (using air, or other oxygen-containing gas) followed by hydrochlorination, with an optional pre-heating of the oxidized feed (potentially under an inert environment of nitrogen or argon) to assist in thermal decomposition of any precious metal oxides (especially of ruthenium and palladium) prior to hydrochlorination. The oxidation also has the dual benefits of making the feed more uniform in composition and rendering a surface morphology more amenable for hydrochlorination.

Figure 2:
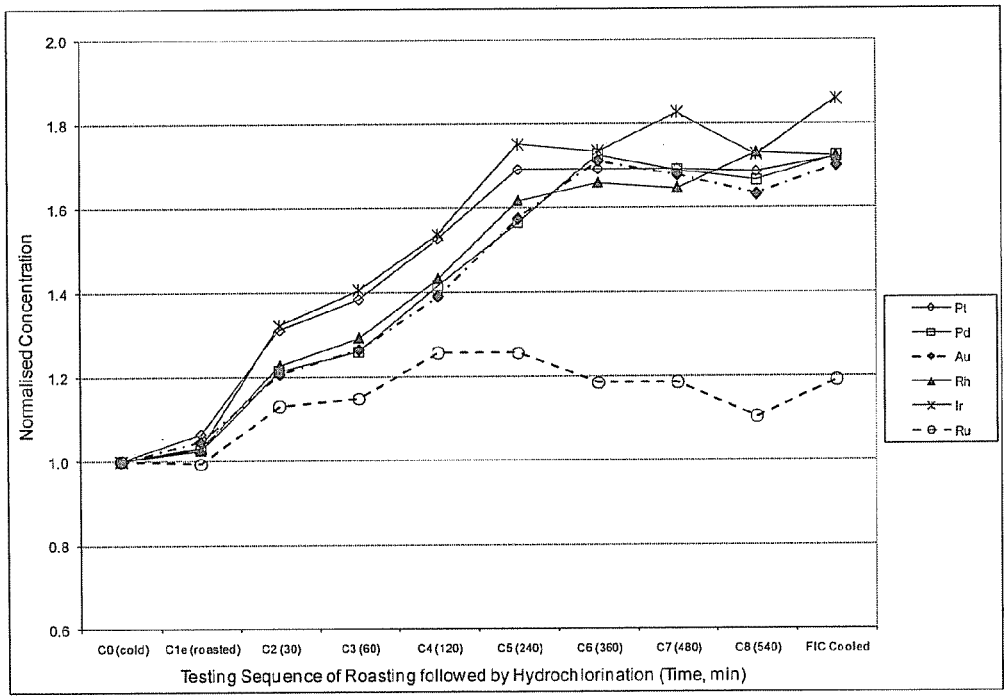
FIG. 2 is a graph indicating the progressive refining of the base metals in accordance with the process of the embodiment referred to in respect of FIG. 1, the composition of each element being normalised by its starting concentration.

The efficiency of the upgrading process of the invention is illustrated in the accompanying FIGS. 1 to 4. FIGS. 1 and 2 confirm the thermodynamically predicted removal sequence for base metal oxides, i.e. copper (Cu)>cobalt (Co)>nickel (Ni)>iron (Fe), and that substantial removal of base metals is indeed possible. Prior oxidation of copper and nickel to oxides, in particular, renders them considerably more amenable to hydrochlorination than equivalent direct hydrochlorination of their untreated metals (the metal oxides thermodynamically requiring an excess molar ratio of $HCl/H_2O$ of between one to two orders of magnitude less for hydrochlorination than the equivalent excess molar ratio of $HCl/H_2$ required for direct hydrochlorination of their respective metals). This obviates many of the difficulties identified previously for direct hydrochlorination of the copper component in particular, which required still further elevated hydrochlorination temperatures to effect removal in acceptable timeframes.

Figure 3:
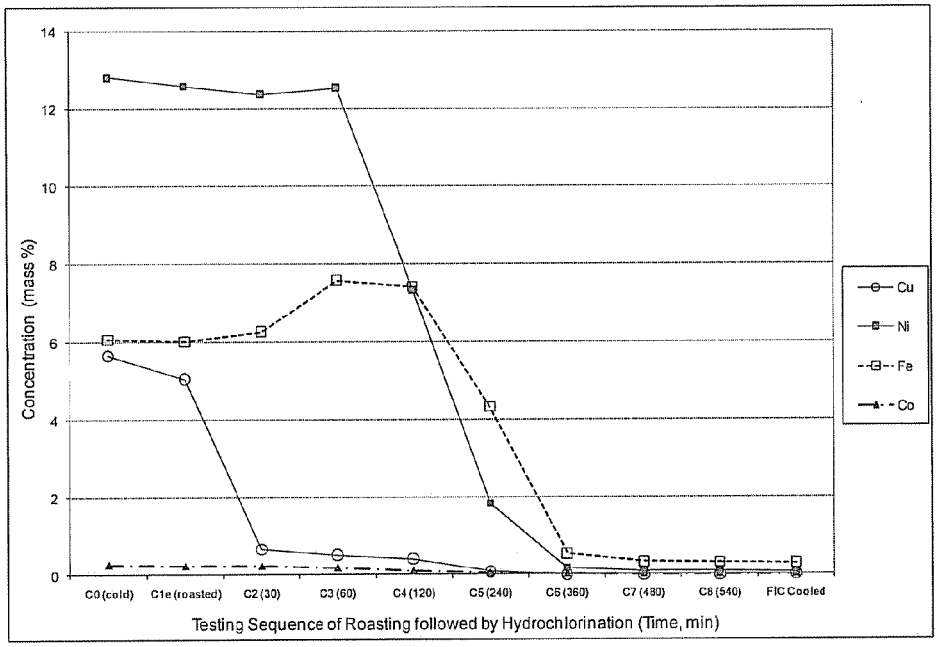
FIG. 3 is a graph indicating the progressive concentration of precious metals into the final residue based on the actual concentration of elements in accordance with the process of an embodiment of the invention.
Figure 4:
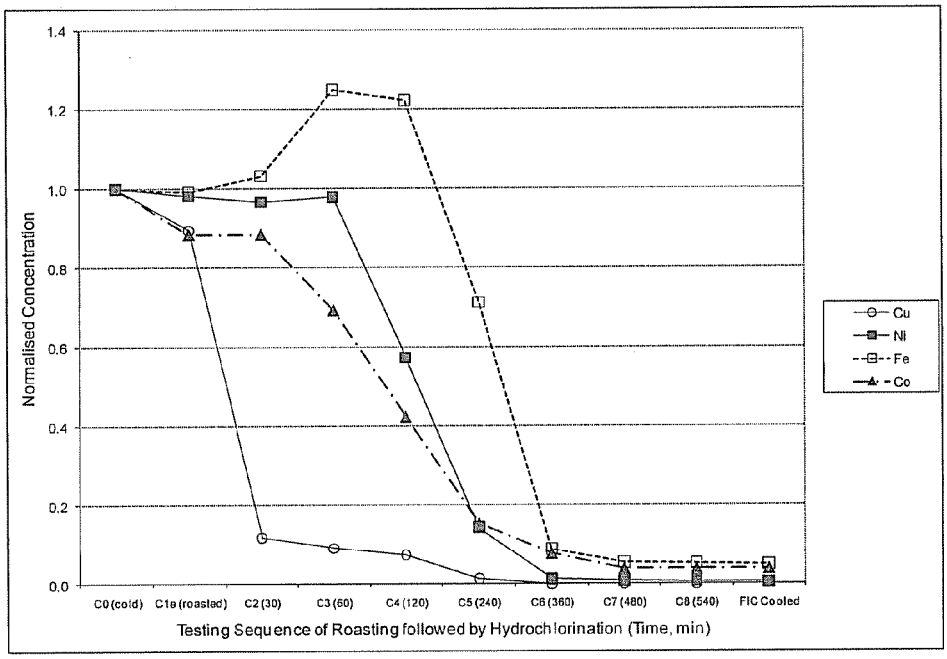
FIG. 4 is a graph indicating the progressive concentration of precious metals in accordance with the process of the embodiment referred to in respect of FIG. 3, the composition of each element being normalised by its starting concentration.

FIGS. 3 and 4 show that the process of the invention provides for substantial upgrading of precious metals during the treatment process. Ruthenium is thermodynamically the most likely precious metal to be lost if the hydrochlorination treatment results in a local $HCl/H_2O$ ratio that is too high through complete removal of the base metal oxides, so dictating that an optimal residence time (and process temperature) for hydrochlorination is still required to limit any losses of volatile, and valuable, precious metal species.

The effectiveness of the process of the invention, in one embodiment thereof, is also demonstrated in Table 1, which sets out the results of the refining of 900 g of a precious metals concentrate to remove base metals, amphoterics and other impurities by a two-stage oxidative pre-treatment and hydrochlorination process.

TABLE 1

| | Feed | (A) Pre-oxidation | (B) Progressive Hydrochlorination Time | | | | (C) Final Concentrate |
|---|---|---|---|---|---|---|---|
| Element | — | 4 h | 30 min. | 1 h | 4 h | 8 h | After cooling |
| | Mass % composition | | | | | | |
| Pt | 29.7 | 31.6 | 38.9 | 41.1 | 50.2 | 50.3 | 51.0 |
| Pd | 15.4 | 15.8 | 18.7 | 19.4 | 24.1 | 26.1 | 25.8 |
| Au | 0.87 | 0.91 | 1.05 | 1.10 | 1.37 | 1.46 | 1.42 |
| Rh | 4.10 | 4.22 | 5.03 | 5.30 | 6.63 | 6.75 | 7.12 |
| Ir | 1.21 | 1.25 | 1.60 | 1.70 | 2.12 | 2.21 | 2.18 |
| Ru | 5.96 | 5.92 | 6.74 | 6.84 | 7.84 | 7.07 | 7.10 |
| Os | 0.02 | 0.00 | 0.00 | 0.00 | 0.00 | 0.00 | 0.00 |
| Ag | 0.26 | 0.25 | 0.05 | 0.04 | 0.01 | 0.03 | 0.01 |
| Cu | 5.66 | 5.06 | 0.67 | 0.52 | 0.08 | 0.00 | 0.00 |
| Ni | 12.8 | 12.6 | 12.4 | 12.5 | 1.83 | 0.10 | 0.06 |
| Fe | 6.07 | 6.02 | 6.26 | 7.58 | 4.32 | 0.33 | 0.27 |
| Co | 0.26 | 0.23 | 0.23 | 0.18 | 0.04 | 0.01 | 0.01 |
| Pb | 1.57 | 1.19 | 0.03 | 0.03 | 0.00 | 0.00 | 0.00 |
| Zn | 0.05 | 0.06 | 0.02 | 0.01 | 0.04 | 0.02 | 0.04 |
| As | 1.17 | 0.94 | 0.54 | 0.37 | 0.03 | 0.03 | 0.00 |
| S | 3.95 | 0.94 | 0.18 | 0.18 | 0.16 | 0.13 | 0.17 |
| Se | 0.76 | 0.13 | 0.00 | 0.00 | 0.00 | 0.00 | 0.00 |
| Te | 0.55 | 0.54 | 0.48 | 0.49 | 0.28 | 0.24 | 0.22 |

As shown in column (A) of Table 1, subsequent to oxidative pre-treatment only, amphoterics such as sulfur (S), selenium (Se), some tellurium (Te), as well as osmium (Os), are removed effectively from the concentrate.
Column (B) indicates a vast increase (almost double) in the precious metals content of a concentrate following pre-oxidation and progressive hydrochlorination treatment.
As set out in column (C) the final concentrate (after both treatment steps) is "clean", with substantial removal of key impurities.

As the results demonstrate, the present invention is not dependent on any intermediate or post-reduction step subsequent to the oxidation step and/or hydrochlorination step. However, because the number and quantities of individual base metal compounds may vary substantially according to the origin of the concentrate, it may be advantageous at times to carry out a suitable post-reduction step, so its use is not specifically precluded.

Similarly, chlorine is less effective than hydrogen chloride to react with metal oxides specifically because the product is oxygen and not water vapour. If chlorine were to be used, an additional reducing agent (e.g., carbon or carbon monoxide) may be required to combine more effectively with product oxygen.

The present invention further effects the removal of silver, which is generally regarded as deleterious to any conventional precious metals refinery.

The oxidative pre-treatment provides for near-quantitative sulfur removal, effective selenium removal and even some tellurium and osmium removal. This is valuable in the treatment of amphoterics-rich sources of precious metals-bearing concentrates and residues. The base metal sulfides would otherwise tend to melt in direct hydrochlorination, so impeding effective reactant gas-solid contact and creating problematic reactor conditions. Another impact of oxidation of base metals is in making the concentrate more porous and open to gas phase reactions, thus improving the hydrochlorination of these oxides. Moreover, in the pre-oxidation of certain precious metals concentrates, a finding serendipitous to the present invention is that the oxidative pre-treatment can effect outward migration of nickel from platinum-rich cores concomitant with inward migration of palladium from "sulfoxide phases" into the metal cores. Temperature and residence time is an important aspect of the oxidation step as there is an enhanced risk of precious metal losses during hydrochlorination if the pre-treatment is conducted at too high a temperature and/or for too long, before being followed by hydrochlorination. In particular, it is identified that it is important to limit combination and generation of any free oxygen with the hydrochlorination step, to limit losses of ruthenium and palladium especially.

As used herein, "sulfoxide phases" includes various mixtures and compounds of precious metals containing sulfur and oxygen.

The oxidation conditions can be controlled to maximize oxidation of base metals and other impurities while minimizing the precious metal losses both during oxidation and subsequent hydrochlorination.

Another embodiment of the invention is the ability to perform a partial oxidative pre-treatment and/or partial hydrochlorination as required by either economics of base metals, amphoterics and other impurities removal and/or feedstock requirements of the downstream precious metals refining process. This indicates the flexibility of the invention to perform impurity refining to the degree that is optimal to the overall process and refining configuration.

The discharge product gas stream of the hydrochlorination step should be sufficiently lean in precious metal chlorides to permit direct treatment of the same to recover and purify the hydrogen chloride gas, so it can be recycled back to the hydrochlorinator, for providing the requisite hydrogen chloride (HCl (g)) excess for the hydrochlorination step. Of course, this does not preclude the possibility of fractional condensation or fractional sublimation to capture any minor precious metal chloride fractions for further recovery prior to the main treatment of the bulk product chlorides for hydrogen chloride recovery.

In some embodiments of the invention the oxidative pre-treatment and/or hydrochlorination steps are performed as a batch sequential process in a single reactor, or two reactors in series. In other embodiments, the process is performed as a continuous operation with discharge of roasted solids from a pre-treatment oxidation reactor into a hydrochlorination reactor. Preferably, the process involves a continuous feeding of the precious metals-bearing concentrates to a rotary kiln to effect oxidative pre-treatment of most base metals to their oxides, the roasting of sulfides, removal of most of the amphoterics to the off gas, and discharge of partially oxidised solids directly into a hydrochlorinator. The continuous discharge of the treated solids, enriched in precious metals, would be concomitant with discharge of reactor product gases containing predominantly base metal, amphoteric, and impurity product chlorides. However, the primary effect invoked through use of the "hydrochlorinating agent" for hydrochlorination (as opposed to direct chlorination with gas mixtures containing chlorine gas), is to limit any such volatile precious metal losses in the first instance.

The method also includes the optional step of flushing each residue with an inert gas, such as nitrogen for example, before each process step at temperature. In the case of the oxidative pre-treatment step, such a pre- or post-thermal processing in an atmosphere substantially free of oxygen may assist in the thermal decomposition of some metal sulfates, and so effect additional refining of deleterious sulfur-bearing species from the precious metals-rich residue.

The process according to embodiments of the invention may include an optional downstream reduction step of the concentrate in a reducing atmosphere, post hydrochlorination. Such a reduction step, if deemed necessary to back-reduce any precious metals oxides, may be carried out with hydrogen or hydrogen-containing gases. However, the use of hydrochlorination alone has been found adequate to yield precious metals sufficiently reduced of oxides so as not to impede precious metals dissolution typical of a conventional downstream precious metals refinery.

One aspect of the invention identified as a means to limit the extent of PGM losses associated with formation of some free chlorine and oxygen during the hydrochlorination of certain metal oxides, is the controlled addition of some hydrogen to react with and mop up such free chlorine and oxygen. This is particularly relevant to the end stages of reaction when most base and impurity metals have been reacted, and so when any PGM metals and oxides are more prone to chlorination to form some volatile PGM chlorides.

The current invention differs substantially from the prior art processes that supply chlorine or produce chlorine in situ to effect metal or metal oxide chlorination in the presence of precious metals. The use of a hydrochlorinating agent, especially when applied following a step of oxidation of base metals, is demonstrated in the present invention to promote the formation and removal by volatilisation of base and impurity metal chlorides from solid precious metal concentrates and residues, but importantly while simultaneously limiting any associated loss of precious metal and precious metal chloride species by volatilisation.

The current invention further specifically identifies the opportunity to perform an oxidative pre-treatment of precious metal concentrates and residues, followed directly by reaction with a hydrochlorinating agent, without the need for any specific intermediate, or final, reduction step.

Whilst some of the identified prior art disclose processes of hydrochlorination of precious metal concentrates as opposed to chlorination with chlorine gas, which is well recognised to help limit losses of precious metals, none of the prior art disclosures recognise the need for oxidative pre-treatment of the feed to:

- effect some impurity removal as volatile oxides up-front of hydrochlorination;
- generally, and in the specific cases of copper and nickel, substantially lower the hydrochlorinating agent gas requirements;
- marginally lower the temperature required for equivalent base metal hydrochlorination and removal, thus lowering the potential for losses of any volatile precious metal and precious metal chloride species;
- render the feed more uniform, and more amenable for reaction with the hydrochlorinating agent, to effect still further removal of volatile base metals and impurities, while simultaneously limiting loss of precious metals.

The invention will now be described in more detail, by way of example only, with reference to the following non-limiting examples.

In all the examples to follow, externally indirectly heated hydrochlorinators were used. It is well known to those skilled in the art that externally heated chlorinators are more prone to corrosion than internally or directly heated hydrochlorinators, even when lined with suitable corrosion-resistant refractories. Thus, for practical implementation of the invention, dilution of the hydrochlorinating agent by nitrogen gas (to simulate a nitrogen plasma carrier gas heat source) was carried out. Again this does not preclude adoption of some suitable heated "inert" gas other than nitrogen. The additional advantage of using an internal or direct source of heating is that a fraction of the reactant gases or nitrogen carrier gas can be super-heated and the remaining gases supplied cold, thus simplifying many engineering and materials of construction and reactor sealing issues.

Still further improvement can be realised through heating the reactant hydrochlorinating agent directly in a suitable gas heater, just prior to delivery into the hydrochlorinator.

EXAMPLE 1

A process used for upgrading a precious metals-containing concentrate (mass 1.5 g containing just over 50% precious metals) through oxidative pre-treatment followed by hydrochlorination with pure anhydrous hydrogen chloride gas was carried out as follows:

- 1.5 g precious metals concentrate was located within an externally heated furnace and heated to a temperature of 600° C. under a nitrogen atmosphere;
- the gas was switched to air at 600° C. for 30 minutes to effect a pre-oxidative roast;
- the gas was then switched to nitrogen and the furnace heated to 950° C.;
- the gas was then subsequently switched to anhydrous hydrogen chloride for 1 hour to effect hydrochlorination;
- flushing and cooling under nitrogen to room temperature was then carried out.

The treated concentrate was substantially upgraded to almost 95% precious metals and substantially cleaned of impurities (see final treated concentrate analysis):

| Element | Feed | Treated concentrate |
|---|---|---|
| | Mass % composition | |
| Pt | 32.8 | 52.0 |
| Pd | 14.5 | 21.4 |
| Au | 0.91 | 1.39 |
| Rh | 4.30 | 6.24 |
| Ir | 1.66 | 2.73 |
| Ru | 6.19 | 10.2 |
| Os | 0.51 | 0.42 |
| Ag | 0.29 | 0.00 |
| Cu | 3.95 | 0.07 |
| Ni | 12.7 | 0.05 |
| Fe | 4.81 | 0.06 |
| Co | 0.17 | 0.00 |
| Pb | 1.14 | 0.03 |
| Zn | 0.00 | 0.00 |
| As | 0.68 | 0.10 |
| S | 2.89 | 0.00 |
| Se | 1.15 | 0.11 |
| Te | 0.43 | 0.47 |
| Bi | 0.12 | 0.03 |
| Sb | 0.14 | 0.00 |
| Sn | 0.03 | 0.01 |
| Precious metals recovery to residue* | | 99% |

*Quantitative definition of recovery is extremely difficult on such a 1.5 g sample.

EXAMPLE 2

A process for upgrading a precious metals-containing concentrate (mass 1.5 g of just over 50% precious metals) involving a hydrometallurgical oxidative pre-treatment, as opposed to a pyrometallurgical oxidative pre-treatment, followed by hydrochlorination was carried out as follows:

- hydrometallurgical oxidation of the precious metals concentrate by leaching in an oxygen-containing environment in an autoclave at a pressure of 18 bar and a temperature of 200° C. for over 2 hours;
- 1.5 g of this hydrometallurgically treated precious metals concentrate was then located within an externally heated furnace and heated to a temperature of 1000° C. under a nitrogen atmosphere;
- the gas was switched to anhydrous hydrogen chloride for 1 hour to effect hydrochlorination;
- flushing and cooling under nitrogen to room temperature was then performed.

The treated concentrate was upgraded to greater than 95% precious metals (see final treated concentrate analysis):

| Element | Feed | Treated concentrate |
|---|---|---|
| | Mass % composition | |
| Pt | 33.4 | 53.7 |
| Pd | 16.2 | 24.2 |
| Au | 1.04 | 1.52 |
| Rh | 3.81 | 5.45 |
| Ir | 1.74 | 2.70 |
| Ru | 4.88 | 7.47 |
| Os | 0.22 | 0.10 |
| Ag | 0.28 | 0.01 |
| Cu | 4.23 | 0.14 |
| Ni | 9.55 | 0.10 |
| Fe | 5.00 | 0.08 |
| Co | 0.12 | 0.00 |
| Pb | 2.09 | 0.02 |
| Zn | 0.03 | 0.00 |
| As | 0.03 | 0.03 |
| S | 0.07 | 0.00 |
| Se | 0.07 | 0.06 |
| Te | 0.36 | 0.01 |
| Sb | 0.10 | 0.00 |
| Precious metals recovery to residue* | | 101% |

*Quantitative definition of recovery is extremely difficult on such a small 1.5 g sample, which explains the reported precious metals recovery above a theoretical 100%.

This example demonstrates that the oxidative pre-treatment step is not limited to a pyrometallurgical process, but can be hydrometallurgical in nature.

EXAMPLE 3

A process in which reactant anhydrous hydrogen chloride gas was diluted with nitrogen to hydrochlorinate a precious metals concentrate (just over 50% precious metals) after pyrometallurgical oxidative pre-treatment was carried out as follows:

- 1.5 g precious metals concentrate was heated within an externally heated furnace to 600° C. under a nitrogen atmosphere;
- the gas was switched to air at 600° C. for 30 minutes to effect a pre-oxidative roast;
- the gas was then switched to nitrogen and the furnace heated to 1000° C.;
- the gas was then subsequently switched to a mixture of anhydrous hydrogen chloride and nitrogen (in a volume ratio of 1:2) for 3 hours to effect hydrochlorination;
- flushing and cooling under nitrogen to room temperature was then carried out.

The treated concentrate was substantially upgraded to almost 95% precious metals and substantially cleaned of impurities (see final treated concentrate analysis):

| Element | Feed | Treated concentrate |
|---|---|---|
| | Mass % composition | |
| Pt | 31.4 | 50.1 |
| Pd | 13.5 | 23.1 |
| Au | 0.87 | 1.41 |
| Rh | 4.01 | 6.52 |
| Ir | 1.59 | 2.61 |
| Ru | 5.95 | 10.3 |
| Os | 0.60 | 0.36 |
| Ag | 0.26 | 0.00 |
| Cu | 3.92 | 0.04 |
| Ni | 12.6 | 0.05 |
| Fe | 4.68 | 0.10 |
| Co | 0.13 | 0.00 |
| Pb | 1.14 | 0.02 |
| Zn | 0.03 | 0.00 |
| As | 0.72 | 0.06 |
| S | 2.77 | 0.00 |
| Se | 1.09 | 0.07 |
| Te | 0.44 | 0.47 |
| Bi | 0.05 | 0.05 |
| Sb | 0.07 | 0.00 |
| Sn | 0.06 | 0.01 |
| Precious metals recovery to residue* | | 99% |

*Quantitative definition of recovery is extremely difficult on such a 1.5 g sample.

This example served to demonstrate the effect of dilution of reactant hydrochlorinating agent gas, to simulate the effect on hydrochlorination performance in the event of the industrial use of a nitrogen (or similar "inert") carrier gas to heat the hydrochlorination reactor.

A decrease in the rate of base metals removal is observed when diluting hydrogen chloride with nitrogen (even while maintaining the same absolute flow rate of hydrogen chloride). This can be compensated for by increasing the hydrochlorination time (and to some extent temperature) without apparent detriment and losses of precious metals within acceptable limits, and dependent on reactor size.

EXAMPLE 4

A process for upgrading a 900 g precious metals concentrate (>50% precious metals) in a bench-scale rotary kiln trial was carried out as follows:

- 900 g precious metals concentrate was located in an externally heated rotary furnace and heated to 600° C. under a nitrogen atmosphere;
- the gas was switched to air at 600° C. for up to 4 hours to effect a pre-oxidative roast;
- the gas was then switched to nitrogen and the furnace heated to 1000° C.;
- the gas was then subsequently switched to a mixture of anhydrous hydrogen chloride and nitrogen (in a volume ratio of 1:2) for up to 8 hours to effect hydrochlorination;
- flushing and cooling under nitrogen to room temperature was then carried out.

The treated concentrate was substantially upgraded to almost 94% precious metals and substantially cleaned of impurities (see final treated concentrate analysis):

| Element | Feed | Treated concentrate |
|---|---|---|
| | Mass % composition | |
| Pt | 29.7 | 50.2 |
| Pd | 15.4 | 26.0 |
| Au | 0.87 | 1.46 |
| Rh | 4.10 | 6.75 |

-continued

| Element | Feed | Treated concentrate |
|---|---|---|
| | Mass % composition | |
| Ir | 1.21 | 2.21 |
| Ru | 5.96 | 7.07 |
| Os | 0.02 | 0.00 |
| Ag | 0.26 | 0.03 |
| Cu | 5.66 | 0.00 |
| Ni | 12.8 | 0.10 |
| Fe | 6.07 | 0.33 |
| Co | 0.26 | 0.01 |
| Pb | 1.57 | 0.00 |
| Zn | 0.05 | 0.02 |
| As | 1.17 | 0.03 |
| S | 3.95 | 0.13 |
| Se | 0.76 | 0.00 |
| Te | 0.55 | 0.24 |
| Sb | 0.00 | 0.00 |
| Precious metals recovery to residue* | | 84% |

*The larger 900 g sample size is more conducive to quantitative calculation of recovery, but the methodology of sampling at defined stages in the reaction again masked true recoveries. Moreover, as the results in Table 1 and depicted in FIGS. 1 to 4 clearly indicate, the loss of precious metals can be limited by shortening the hydrochlorination, with no substantial detriment to effective base metal, amphoteric and impurity removal.

The chemical analysis of the condensed volatile components showed them to contain base metals, amphoterics and impurity elements in the substantial absence of significant amounts of precious metals.

EXAMPLE 5

A process for upgrading a low-grade precious metals-containing residue (7.5 g mass containing just less than 1% precious metals) involving oxidative pre-treatment followed by hydrochlorination was carried out as follows:

- 7.5 g precious metals residue was located within an externally heated furnace and heated to a temperature of 600° C. under a nitrogen atmosphere;
- the gas was switched to air at 600° C. for 2 hours to effect a pre-oxidative roast;
- the gas was then switched to nitrogen and the furnace heated to 1000° C.;
- the gas was then subsequently switched to anhydrous hydrogen chloride for 2 hours to effect hydrochlorination;
- flushing and cooling under nitrogen to room temperature was then performed.

The treated residue was substantially upgraded to approximately 11% precious metals. The bulk of material in the treated residue was identified to be mainly silicates (see final treated residue analysis):

| Element | Feed | Treated residue |
|---|---|---|
| | Mass % composition | |
| Pt | 0.04 | 1.77 |
| Pd | 0.31 | 5.25 |
| Au | 0.04 | 0.42 |
| Rh | 0.10 | 1.81 |
| Ir | 0.01 | 0.26 |
| Ru | 0.21 | 1.86 |
| Os | 0.06 | 0.03 |
| Ag | 0.31 | 0.00 |
| Cu | 3.93 | 0.55 |
| Ni | 0.31 | 0.03 |
| Fe | 25.6 | 0.40 |
| Co | 0.01 | 0.00 |
| Pb | 1.10 | 0.00 |
| Zn | 0.03 | 0.01 |

-continued

| Element | Feed | Treated residue |
|---|---|---|
| | Mass % composition | |
| As | 0.00 | 0.02 |
| S | 24.7 | 0.26 |
| Se | 0.56 | 0.02 |
| Te | 0.16 | 0.02 |
| Sb | 0.03 | 0.00 |
| Precious metals recovery to residue* | | 87% |

*Quantitative definition of recovery is extremely difficult on such a small 7.5 g sample.

This example demonstrated the capability of the process outlined in this invention to refine a low-grade residue containing less than 1% precious metals by a factor of ten.

EXAMPLE 6

A bench-scale rotary treatment process for upgrading a 400 g precious metals residue (containing ~15% precious metals) by oxidative pre-treatment followed by hydrochlorination with anhydrous hydrogen chloride gas diluted with nitrogen was carried out as follows:

- 400 g precious metals residue was located in an externally heated rotary furnace and heated to a temperature of 600° C. under a nitrogen atmosphere;
- the gas was switched to air at 600° C. for up to 4 hours to effect a pre-oxidative roast;
- the gas was then switched to nitrogen and the furnace heated to 1000° C.;
- the gas was subsequently switched to a mixture of anhydrous hydrogen chloride and nitrogen (in a volume ratio of 1:2) for up to 4 hours to effect hydrochlorination;
- flushing and cooling under nitrogen to room temperature was then carried out.

The treated residue was substantially upgraded to almost 93% precious metals and substantially cleaned of impurities (see final treated residue analysis):

| Element | Feed | Treated residue |
|---|---|---|
| | Mass % composition | |
| Pt | 5.00 | 33.0 |
| Pd | 3.35 | 34.2 |
| Au | 0.35 | 1.90 |
| Rh | 1.47 | 9.77 |
| Ir | 0.18 | 1.78 |
| Ru | 2.14 | 12.1 |
| Os | 1.14 | 0.02 |
| Ag | 0.03 | 0.00 |
| Cu | 37.8 | 0.05 |
| Ni | 4.90 | 0.07 |
| Fe | 1.66 | 0.03 |
| Co | 0.00 | 0.00 |
| Pb | 0.35 | 0.00 |
| Zn | 0.00 | 0.00 |
| As | 0.41 | 0.03 |
| S | 11.4 | 0.00 |
| Se | 0.10 | 0.16 |
| Te | 0.40 | 0.31 |
| Sb | 0.00 | 0.00 |
| Precious metals recovery to residue* | | 87% |

*The larger 400 g sample size is again more conducive to quantitative calculation of recovery, but the methodology of sampling at defined stages in the reaction again masked true recoveries, coupled again with the effect of deliberate hydrochlorination as described in the previous example to try to establish the optimum limits to effect impurity removal prior to the observed loss of precious metals.

EXAMPLE 7

A process for upgrading a 600 g precious metals concentrate (>50% precious metals) in a bench-scale rotary kiln trial was carried out as follows:

- 600 g precious metals concentrate was located in an externally heated rotary furnace and heated to 600° C. under a nitrogen atmosphere;
- the gas was switched to air at 600° C. for up to 4 hours to effect a pre-oxidative roast;
- the gas was then switched to nitrogen and the rotary furnace was heated to 1000° C.;
- the gas was then subsequently switched to anhydrous hydrogen chloride for up to 8 hours to effect hydrochlorination;
- flushing and cooling under nitrogen to room temperature was then carried out.

The treated concentrate was substantially upgraded to 94% precious metals and substantially cleaned of impurities (see final treated concentrate analysis):

| Element | Feed | Treated concentrate |
|---|---|---|
| | Mass % composition | |
| Pt | 37.05 | 64.20 |
| Pd | 11.19 | 18.17 |
| Au | 0.65 | 0.96 |
| Rh | 2.52 | 3.90 |
| Ir | 2.09 | 3.45 |
| Ru | 4.04 | 3.44 |
| Os | 0.50 | 0.04 |
| Ag | 0.18 | 0.00 |
| Cu | 4.19 | 0.00 |
| Ni | 12.47 | 0.05 |
| Fe | 5.92 | 0.11 |
| Co | 0.20 | 0.00 |
| Pb | 1.00 | 0.11 |
| Zn | 0.04 | 0.00 |
| As | 0.51 | 0.05 |
| S | 1.34 | 0.00 |
| Se | 0.44 | 0.08 |
| Te | 0.19 | 0.00 |
| Sb | 0.14 | 0.01 |
| Precious metals recovery to residue* | | 80% |

*The larger 600 g sample size is again more conducive to quantitative calculation of recovery, but the methodology of sampling at defined stages in the reaction again masked true recoveries, coupled again with the effect of deliberate hydrochlorination as described in the previous example to try to establish the optimum limits to effect impurity removal prior to the observed loss of precious metals.

Figure 5:
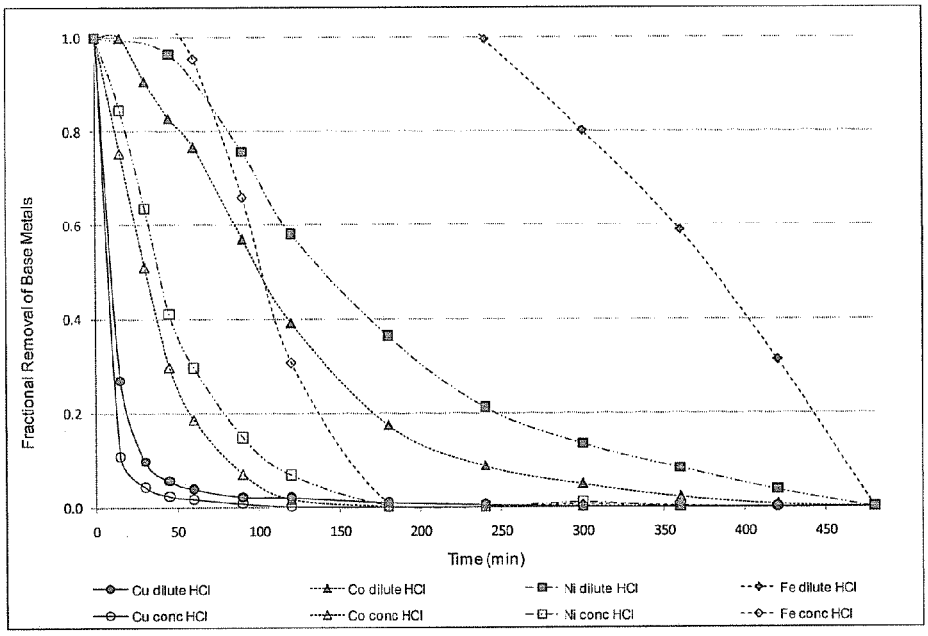
FIG. 5 is a graph indicating the increased rate of progressive refining of base metals based on their fractional removal with time, as a function of increased hydrochlorinating agent concentration, in accordance with the process of an embodiment of the invention.

As depicted graphically in accompanying FIG. 5, the example demonstrates the significant increase in rate of base metals removal that can be achieved through use of a concentrated hydrochlorinating agent, when compared to a hydrochlorinating agent diluted with nitrogen.

EXAMPLE 8

A process was developed for upgrading a precious metals-containing concentrate (mass 1.5 g containing just over 50% precious metals) through oxidative pre-treatment followed by hydrochlorination to demonstrate the use of a controlled HCl: $H_2O$ ratio in the hydrogen chloride gas stream to limit precious metal losses (especially ruthenium). 1.5 g portions of precious metals-containing concentrate were hydrochlorinated over increasing time intervals, both with and without controlled water vapour addition, to demonstrate the effect of limiting precious metal losses. The experiment was carried out as follows:

a precious metals concentrate was located within an externally heated furnace and heated to a temperature of 600° C. under a nitrogen atmosphere;

the gas was switched to air at 600° C. for 30 minutes to effect a pre-oxidative roast;

the precious metal concentrate was removed from the furnace and the furnace was heated to 1000° C. under a nitrogen atmosphere;

1.5 g of the precious metals concentrate was placed into the furnace and the gas switched to hydrogen chloride with water in a 7:1 HCl:$H_2O$ ratio for a maximum of 2 hours to effect hydrochlorination;

flushing and cooling with nitrogen to room temperature was then carried out.

The treated concentrate resulting from tests with water addition was still substantially upgraded to almost 94% precious metals and substantially cleaned of impurities (see final treated concentrate analysis):

| Element | Feed | Treated concentrate with water addition |
|---|---|---|
| | Mass % composition | |
| Pt | 40.28 | 53.79 |
| Pd | 11.84 | 23.49 |
| Au | 0.69 | 1.44 |
| Rh | 2.61 | 4.94 |
| Ir | 2.29 | 2.88 |
| Ru | 4.23 | 6.80 |
| Os | 0.47 | 0.16 |
| Ag | 0.18 | 0.00 |
| Cu | 4.46 | 0.10 |
| Ni | 13.10 | 0.38 |
| Fe | 5.91 | 0.25 |
| Co | 0.21 | 0.00 |
| Pb | 0.96 | 0.12 |
| Zn | 0.04 | 0.00 |
| As | 0.55 | 0.06 |
| Bi | 0.06 | 0.01 |
| S | 0.06 | 0.00 |
| Se | 0.16 | 0.06 |
| Te | 0.20 | 0.23 |
| Sb | 0.15 | 0.02 |
| Precious metals recovery to residue* | | 99.8% |

*Quantitative definition of recovery is extremely difficult on the 1.5 g scale

Figure 6:
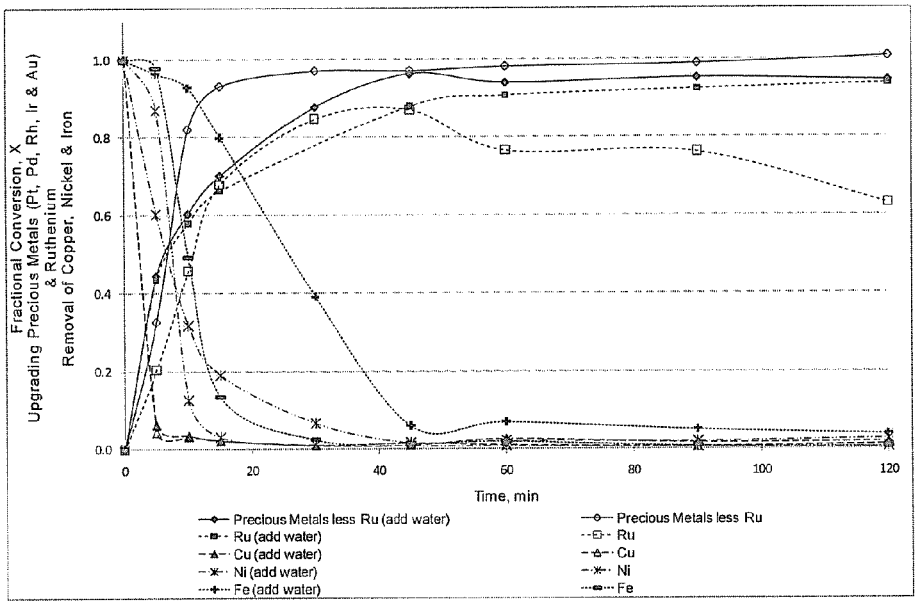
FIG. 6 is a graph indicating how despite progressive removal of base metals, losses of precious metals, in particular ruthenium, are limited by addition of water in a controlled manner to fix the inlet $HCl/H_2O$ ratio during the hydrochlorination step, in accordance with the process of an embodiment of the invention.

This example demonstrates that addition of water vapour to the hydrochlorinating gas stream has a negligible effect on the rate of copper removal; limited effect on the rates of base metal nickel and iron removal and the rate of upgrading of combined precious metals (less ruthenium), while substantially reducing losses of ruthenium that are mainly experienced following substantial removal of base metals and associated longer hydrochlorination times. This is depicted graphically in accompanying FIG. 6.

COMPARATIVE EXAMPLE 1

A process to demonstrate the effect when reactant chlorine gas is used in an attempt to selectively chlorinate a precious metals concentrate (>50% precious metals), was carried out as follows:

1.5 g precious metals concentrate was located within an externally heated furnace and heated to a temperature of 938° C. under a nitrogen atmosphere;

the gas was switched to chlorine over 2 hours to effect chlorination;

flushing and cooling under nitrogen to 500° C. was then carried out;

the gas was then switched to hydrogen at 500° C. over 2 hours;

lastly, flushing and cooling under nitrogen to room temperature was carried out.

Direct chlorination resulted in upgrading of the precious metals content of the treated concentrate (see final treated concentrate analysis):

| Element | Feed | Treated concentrate |
|---|---|---|
| | Mass % composition | |
| Pt | 30.9 | 60.0 |
| Pd | 15.0 | 24.1 |
| Au | 0.93 | 0.79 |
| Rh | 4.84 | 7.55 |
| Ir | 1.37 | 2.77 |
| Ru | 5.65 | 0.93 |
| Os | 0.57 | 0.04 |
| Ag | 0.31 | 0.01 |
| Cu | 4.51 | 0.02 |
| Ni | 13.0 | 0.10 |
| Fe | 4.43 | 0.07 |
| Co | 0.14 | 0.00 |
| Pb | 1.12 | 0.02 |
| Zn | 0.03 | 0.00 |
| As | 0.69 | 0.03 |
| S | 2.91 | 0.00 |
| Se | 1.14 | 0.01 |
| Te | 0.44 | 0.00 |
| Bi | 0.12 | 0.00 |
| Sb | 0.14 | 0.01 |
| Sn | 0.03 | 0.00 |
| Precious metals recovery to residue* | | 87% |

*Quantitative definition of recovery is extremely difficult on such a 1.5 g sample.

It is evident that high-temperature chlorination of precious metals concentrate with chlorine gas indeed showed rapid removal of base metals, amphoterics and impurity elements. But it also gave correspondingly higher losses of precious metals (with the exception of Pt in this instance) to the volatile fraction, particularly once base metals had been removed.

Use of a hydrochlorinating agent is therefore generally desired over chlorine leading to equivalently lower losses of precious metals. Further control of the process to decrease hydrochlorination rates near the end of the overall hydrochlorination process is also possible (for example, by further adjusting the incoming HCl to $H_2O$ ratio and/or temperature) and this can especially allow for improved separation of other volatile metal chlorides while keeping the precious metals intact in the treated solid product.

The invention claimed is:

1. A process for upgrading a precious metals-containing concentrate or residue comprising base metal contaminants and one or more precious metals selected from the group consisting of gold, platinum, palladium, rhodium, ruthenium and iridium, the process including the steps of:

oxidative pre-treatment of the precious metals-containing concentrate or residue by exposing the concentrate or residue to oxygen or an oxygen-containing environment, forming a pre-treated concentrate or residue comprising base metal oxides and the one or more precious metals; and hydrochlorination of the pre-treated concentrate or residue comprising base metal oxides and the one or more precious metals, without an intermediate reduction step between the oxidative pretreatment and the hydrochlorination, by exposing the pre-treated concentrate or residue comprising base metal oxides and the one or more precious metals to a gaseous hydrochlorinating agent such that at least a portion of the base metal oxides are selectively removed to form an upgraded concentrate or residue.

2. A process according to claim 1, wherein the oxidative pre-treatment step comprises pyrometallurgical oxidation of the precious metals-containing concentrate or residue.

3. A process according to claim 2, wherein the pyrometallurgical oxidation is carried out under an oxygen or oxygen-containing atmosphere, at a temperature of between 200° C. and 1400° C.

4. A process according to claim 3, wherein the pyrometallurgical oxidation is carried out at a temperature of between 400° C. and 900° C.

5. A process according to claim 1, wherein the oxidative pre-treatment step comprises hydrometallurgical oxidation of the precious metals-containing concentrate or residue.

6. A process according to claim 5, wherein the hydrometallurgical oxidation is carried out at a temperature of between 50° C. and 300° C.

7. A process according to claim 6, wherein the hydrometallurgical oxidation is carried out at a temperature of between 100° C. and 200° C.

8. A process according to claim 1, including the step of thermal decomposition of sulfur present as sulfates in the concentrate or residue at a temperature up to 1300° C. substantially in the absence of oxygen, either prior to or after the oxidative pre-treatment step.

9. A process according to claim 1, wherein the hydrochlorination step is conducted substantially in the absence of free oxygen in the gas phase, to limit loss of precious metals.

10. A process according to claim 1, wherein the hydrochlorinating agent is hydrogen chloride gas.

11. A process according to claim 1, wherein the hydrochlorination step is carried out at a temperature of between 650° C. and 1300° C.

12. A process according to claim 11, wherein the hydrochlorination step is carried out at a temperature of between 800° C. and 1100° C.

13. A process according to claim 1, wherein the oxidative pre-treatment step removes some volatile amphoteric and impurity species prior to the hydrochlorination step.

14. A process according to claim 1, wherein the concentrate or residue comprises a precious metals content ranging from 0.5% to 60% by weight.

15. A process according to claim 1, wherein the concentrate or residue contains in excess of 20% by weight precious metals.

16. A process according to claim 1, wherein during the hydrochlorination step, water is added in a controlled manner to control a ratio of hydrogen chloride (HCl) to water ($H_2O$), thereby to limit formation of precious metal chlorides and resultant losses.

17. A process according to claim 16, wherein the controlled water addition limits the loss of ruthenium.

18. A process according to claim 1, wherein during the hydrochlorination step, hydrogen gas is added in a controlled manner to scavenge any trace amounts of chlorine and/or oxygen present.

19. The process of claim 1, wherein the oxidative pre-treatment does not include leaching.

20. A process for upgrading a precious-metals containing concentrate or residue comprising base metal contaminants and one or more precious metals selected from the group consisting of gold, platinum, palladium, rhodium, ruthenium and iridium, the process including the steps of:

pyrometallurgical oxidative pre-treating the precious metals-containing concentrate or residue by exposing the precious metals-containing concentrate or residue to oxygen or an oxygen-containing atmosphere to form a pre-treated concentrate or residue, wherein the base metal contaminants are oxidized to render the base metal contaminants suitable for refining from the precious metals-containing concentrate or residue by hydrochlorination; and hydrochlorinating the pre-treated concentrate or residue, without an intermediate reduction step between the oxidative pretreatment and the hydrochlorination, by exposing the pre-treated concentrate or residue to a gaseous hydrochlorinating agent such that at least a portion of the base metal contaminants are selectively removed to form an upgraded concentrate or residue.

* * * * *